US010448728B1

(12) United States Patent
Gregory et al.

(10) Patent No.: US 10,448,728 B1
(45) Date of Patent: Oct. 22, 2019

(54) WEARABLE ITEM CARRIER

(71) Applicant: Surf Stash, LLC, Sanford, FL (US)

(72) Inventors: Michael Gregory, Sanford, FL (US); Keiley Gregory, Sanford, FL (US); Marie Gregory, Sanford, FL (US)

(73) Assignee: Surf Stash, LLC, Sanford, FL (US)

( * ) Notice: Subject to any disclaimer, the term of this patent is extended or adjusted under 35 U.S.C. 154(b) by 0 days.

(21) Appl. No.: 15/865,588

(22) Filed: Jan. 9, 2018

Related U.S. Application Data

(60) Provisional application No. 62/551,568, filed on Aug. 29, 2017, provisional application No. 62/445,077, filed on Jan. 11, 2017.

(51) Int. Cl.
*A45F 5/02* (2006.01)
*A45F 3/14* (2006.01)
*A45F 5/00* (2006.01)

(52) U.S. Cl.
CPC ..... *A45F 5/02* (2013.01); *A45F 3/14* (2013.01); *A45F 5/021* (2013.01); *A45F 2005/008* (2013.01); *A45F 2200/0558* (2013.01)

(58) Field of Classification Search
CPC ..... A45F 5/021; A45F 2005/008; A45F 2200/0558
USPC ..... 224/672, 675
See application file for complete search history.

(56) References Cited

U.S. PATENT DOCUMENTS 1,559,270 A 10/1925 Miller
2,048,344 A 7/1936 Lillie
4,139,133 A * 2/1979 Repka ..... A45C 1/04 2/920
4,165,826 A * 8/1979 Chica ..... F41C 33/0209 224/191
4,174,793 A * 11/1979 Wisowaty ..... A45C 11/32 224/240
4,341,331 A 7/1982 McDougall
4,421,150 A 12/1983 Masters
4,907,729 A * 3/1990 Hess, III ..... A45C 1/04 224/240
4,964,508 A * 10/1990 Balsley ..... A45C 11/32 150/143
5,104,076 A * 4/1992 Goodall, Jr. ..... A45F 5/02 224/251
5,233,942 A * 8/1993 Cooper ..... A01K 27/008 119/792
5,645,205 A 7/1997 Kennedy
5,683,022 A * 11/1997 Evans ..... A41F 9/002 224/583
5,693,006 A * 12/1997 Slautterback ..... A61F 5/028 2/48

(Continued)

FOREIGN PATENT DOCUMENTS

DE 434871 10/1926
JP 10033237 2/1998

(Continued)

*Primary Examiner* — Justin M Larson

(74) *Attorney, Agent, or Firm* — Christopher M. Ramsey; GrayRobinson, P.A.

(57) ABSTRACT

An item carrier includes a body having a front side defining an item storage area capable of removably holding an item to be stored and a belt fastener member. The belt fastener member is attached to the body and is configured to fasten to a belt in such a way that the belt fastener member forms a loop around the belt and adheres to the belt.

15 Claims, 13 Drawing Sheets

(56) References Cited

U.S. PATENT DOCUMENTS

| | | | | |
|---|---|---|---|---|
| 5,711,469 | A * | 1/1998 | Gormley | A45F 5/02 224/236 |
| 6,112,961 | A | 9/2000 | Phillips | |
| 6,296,164 | B1 | 10/2001 | Russo | |
| 6,412,674 | B1 * | 7/2002 | Lipke | A45C 7/00 224/235 |
| 6,478,205 | B1 * | 11/2002 | Fujihashi | A45F 5/02 224/236 |
| 6,568,574 | B2 | 5/2003 | Jones et al. | |
| 6,832,712 | B2 | 12/2004 | Turner | |
| 7,686,196 | B2 | 3/2010 | Panosian et al. | |
| 7,743,540 | B2 | 6/2010 | McDermott | |
| 7,770,770 | B2 * | 8/2010 | Murdoch | A45C 11/38 224/672 |
| 8,225,976 | B2 * | 7/2012 | Meunier | A45F 5/02 224/672 |
| 8,256,652 | B2 | 9/2012 | Murdoch et al. | |
| 8,453,898 | B2 | 6/2013 | Ewins | |
| D686,688 | S | 7/2013 | Vinano | |
| D721,227 | S | 1/2015 | Milligan | |
| D737,569 | S * | 9/2015 | Hamilton | D3/218 |
| D738,104 | S * | 9/2015 | Hamilton | D3/218 |
| D739,137 | S * | 9/2015 | Hamilton | D3/218 |
| 9,232,850 | B2 | 1/2016 | Moreau et al. | |
| 9,565,922 | B2 | 2/2017 | Cole et al. | |
| 9,750,331 | B2 * | 9/2017 | Carver | A45F 5/00 |
| 2002/0175197 | A1 * | 11/2002 | Cummins | A01K 27/006 224/675 |
| 2003/0094470 | A1 * | 5/2003 | Cragg | A45F 5/021 224/236 |
| 2004/0182896 | A1 | 9/2004 | Ballard | |
| 2006/0011687 | A1 | 1/2006 | Wadley et al. | |
| 2006/0261107 | A1 | 11/2006 | Daniels | |
| 2014/0263521 | A1 * | 9/2014 | Hamilton | A45F 5/021 224/675 |
| 2019/0116966 | A1 * | 4/2019 | Gregory | A45F 5/021 |

FOREIGN PATENT DOCUMENTS

| | | | |
|---|---|---|---|
| WO | 1993005676 | A1 | 4/1993 |
| WO | 2007109078 | A3 | 10/2008 |

* cited by examiner

WEARABLE ITEM CARRIER

CROSS-REFERENCE TO RELATED APPLICATION

This claims priority from provisional Application No. 62/445,077, filed Jan. 11, 2017, and provisional Application No. 62/551,568, filed Aug. 9, 2017, which are incorporated by reference herein in their entireties.

BACKGROUND

People who engage in watersports such as surfing, kite-boarding, jet skiing, and paddle boarding often want to carry certain items with them out on or into the water, but finding a place to carry the items can be difficult. The items can fall out of swim trunk pockets and wetsuits and women's swimsuits rarely have pockets. Also, these items, when attached directly to a person's clothing or body via lanyard or semi-permanent attachment can be cumbersome to carry and difficult to quickly access and replace with one hand.

BRIEF SUMMARY

In view of this problem, a wearable apparatus is needed to allow people to carry items on their bodies while engaged in a watersport or any other activity in which a person might want to use such a wearable apparatus. Such an apparatus is an item carrier.

A first example of the item carrier includes a body having a front side defining an item storage area capable of removably holding an item to be stored and a belt fastener member. The belt fastener member is attached to the body and includes a first touch fastener panel. The belt fastener member being configured to fasten to a belt in such a way that the belt fastener member forms a loop around the belt and the first touch fastener panel adheres to the belt.

The item storage area may be on a front side of the body and a second touch fastener panel may be on a back side of the body.

The belt fastener member may include a loop forming strap attached to the body and the first touch fastener panel may be positioned on a surface of the loop forming strap that faces the body.

The first and second touch fastener panels may be made of different touch fastener material.

The item storage area may include a pocket having a lid strap that closes the pocket and a locking strap that overlaps the lid strap and adheres to the lid strap with a touch fastener.

The item storage area includes a pocket having a lid strap that closes the pocket and a locking strap that transversely overlaps the lid strap and adheres to the lid strap with a touch fastener.

The belt fastener member may form a loop around the belt and the belt may be positioned between and in direct contact with the first touch fastener panel and second touch fastener panel.

A third touch fastener panel may be positioned on the loop forming strap on an opposite side of the loop forming strap from the first touch fastener panel.

The first touch fastener panel may be either a hook or a pile of a hook and pile fastener.

A second example of the item carrier includes a body having a front side defining an item storage area capable of removably holding an item to be stored. A belt fastener member is attached to the body for fastening to a belt, the belt fastener member has a first section with a first touch fastener panel thereon and a second section with a second touch fastener panel thereon, the first section and second section together being formable into a loop in such a way that that the first and second touch fastener panels are inside the loop. The first and second touch fastener panels are made of different touch fastener material.

The item storage area may be on a front side of the body and the second touch fastener panel may be on a back side of the body.

The belt fastener member may include a loop forming strap attached to the body and the first touch fastener panel may be positioned on the loop forming strap.

The belt fastener member may include a loop forming strap attached to the body, the first touch fastener panel may be positioned on the loop forming strap, and a third touch fastener panel may be positioned on the loop forming strap on an opposite side of the loop forming strap from the first touch fastener panel.

The item storage area may include a pocket having a lid strap that closes the pocket and a locking strap that overlaps the lid strap and adheres to the lid strap with a touch fastener.

The item storage area may include a pocket having a lid strap that closes the pocket and a locking strap that transversely overlaps the lid strap and adheres to the lid strap with a touch fastener.

The first touch fastener panel may either a hook or a pile of a hook and pile fastener and the second touch fastener panel may be the other of a hook or a pile of a hook and pile fastener.

A third example of the item carrier includes a body having a front side defining an item storage area capable of removably holding an item to be stored and a back side having a first touch fastener panel thereon. A loop forming strap extends from the body over the back side, the loop forming strap having an inside surface facing the back side and an outside surface opposite the inside surface. The inside surface including a second touch fastener panel made of different touch fastener material than the first touch fastener panel. The outside surface including a third touch fastener panel.

The item storage area may include a pocket having a lid strap that closes the pocket and a locking strap that overlaps the lid strap and adheres to the lid strap with a touch fastener.

The item storage area may include a pocket having a lid strap that closes the pocket and a locking strap that transversely overlaps the lid strap and adheres to the lid strap with a touch fastener.

The loop forming strap may be configured to fasten to a belt in such a way that the loop forming strap forms a loop around the belt and the second touch fastener panel adhere to the belt.

DESCRIPTION OF EXAMPLE EMBODIMENTS

Figure 1:
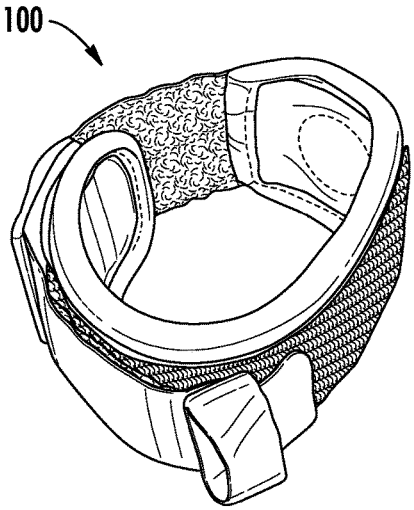
FIG. 1 PRIOR ART
FIG. 1 is an example of a belt that may be used in combination with the item carrier.

This disclosure describes example aspects and embodiments, but not all possible aspects and embodiments of the item carrier. Where a particular feature is disclosed in the context of a particular aspect or embodiment, that feature can also be used, to the extent possible, in combination with and/or in the context of other aspects and embodiments. The item carrier may be embodied in many different forms and should not be construed as limited to only the examples described here.

The item carrier is adapted to be removably attached to a belt or the like that is wearable around a person's waist or appendage such as an arm or leg. There are many different types of conventional belts that may be used in combination with the item carrier.

One such type of conventional belt 100 is depicted in FIGS. 1-4. This belt 100 is particularly adapted for use when conducting watersports such as surfing and paddleboarding for example. In some scenarios, the belt 100 may include a leash 102 that can be attached at one end to the board or equipment being used. The leash 102 may not always be necessary.

The belt 100 includes an elongated belt body 104 extending between a first end 106 and a second end 108. An outer surface 110 of the belt 100 faces away from the wearer's body when worn. An inner surface 112 of the belt 100 contacts the wearer's skin and/or overlays the outside of the belt 100 when worn so as to lock the belt around the wearer's appendage.

The belt 100 is secured to the person's appendage using a touch fastener. The term "touch fastener" refers to a pair of strips of material that adhere to each other when pressed together by hand and separate from each other when peeled apart. Examples of touch fasteners include, but are not limited to, hook and loop or hook and pile fasteners such as VELCRO, pressure sensitive adhesives, and the like.

As used in this disclosure, a "touch fastener panel" refers to a panel made of touch fastener material, which is material suitable for forming a touch fastener. If the touch fastener is a hook and pile fastener, then the touch fastener would include a touch fastener panel made of the hook portion and a touch fastener panel made of the pile portion.

When the term different touch fastener panel material is used to describe touch fastener panels relative to each other, it means that the two touch fastener panels being discussed are made of mateable touch fastener material that can adhere together.

The touch fastener of the belt in FIGS. 1-4 is a hook and pile system. The outer surface 110 of the belt 100 has a touch fastener panel 116 positioned along its length. The inner surface 112 of the belt has the other touch fastener panel 118 positioned along its length. When the first end 106 overlaps the second end 108 and the two ends are pressed together, the touch fastener panels 116, 118 adhere together as shown in FIG. 1, securing the belt to the person's appendage.

For vigorous watersports such as surfing, a belt 100 with a leash 102 is typically worn to prevent the surfboard from floating away from the surfer when the surfer falls into the water. Because such falls can be violent, the integrity of the attachment between the touch panels 116, 118 is important. If the attachment is weak, the belt might fall off and the surfboard can float away, possibly striking another person and leaving the surfer without a flotation device.

Although the item carrier does not necessarily have to be used in combination with such a belt 100, it is advantageously designed to attach to one or both touch panels 116, 118 of such a belt 100 by including its own strategically positioned touch fastener panels described below that are strategically positioned so as not to interfere with the integrity of the belt's 100 touch fastener when it is being worn.

This is a safety feature that ensures substantially all portions of the belt touch fastener panels are either connected to each other or to the mating touch fastener panels on the item carrier, which better prevents the belt from being ripped off the wearer's appendage during a fall.

Figure 2:
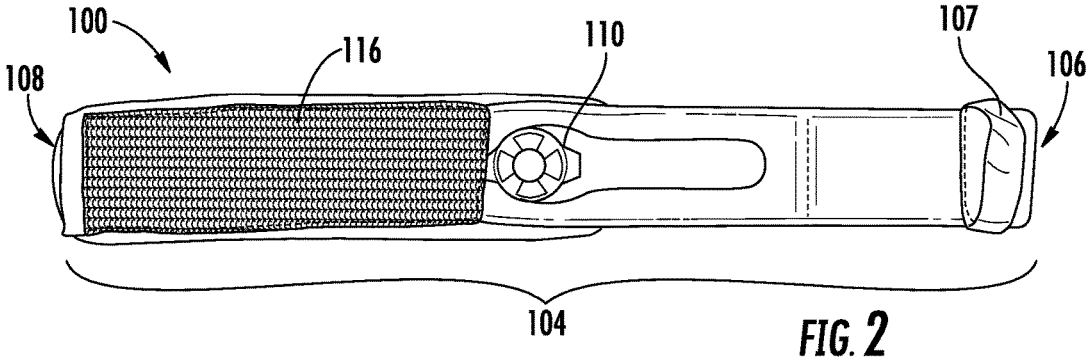
FIG. 2 PRIOR ART
FIG. 2 is a plan view of the belt of FIG. 1 showing the outside surface of the belt.
Figure 3:
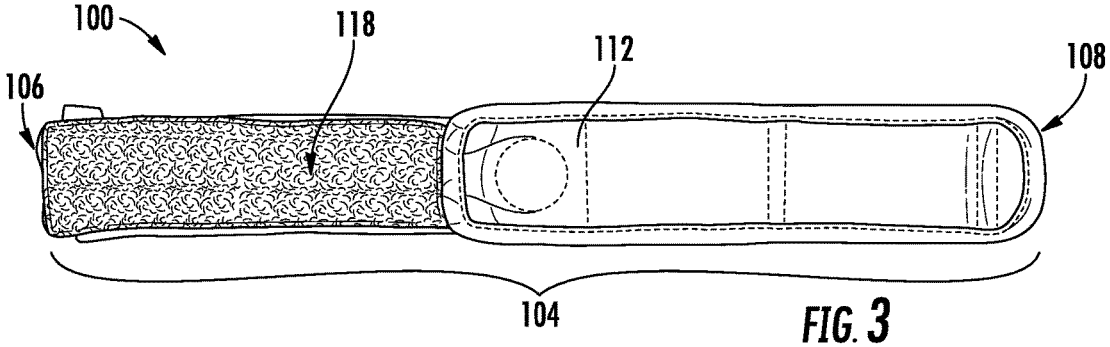
FIG. 3 PRIOR ART
FIG. 3 is a plan view of the belt of FIG. 1 showing the inside surface of the belt.
Figure 4:
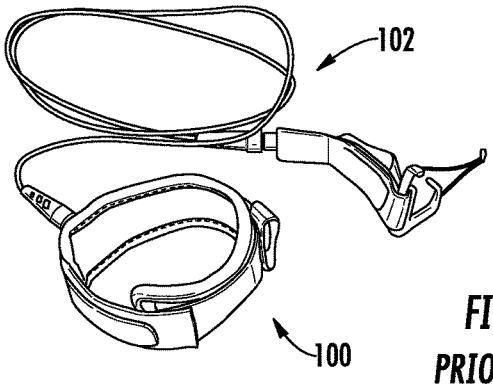
FIG. 4 PRIOR ART
FIG. 4 is an example of a belt with a leash that connects the belt to equipment used in the sport that may be used in combination with the item carrier.

The belt illustrated in FIG. 2 has a pull tab 107 located at the first end 106 of the outer surface 110. Wearer's remove the belt from their appendage by grabbing the pull tab 107 and pulling the belt apart, thereby separating the touch fastener panels 116, 118 on the belt. The configuration of the item carrier and its touch fastener panels allow the wearer to position the item carrier in multiple belt locations depending on the wearer's preference and appendage circumference while not interfering with the wearer's ability grasp the pull tab 107 and quickly remove the belt.

This is an advantageous feature, as there are times when the belt 100 or leash 102 may become wrapped around an underwater object, trapping the wearer underwater. Once the belt is removed, touch fastener panels on the item carrier described below ensure that the item carrier remains connected to the belt 100 so that the item carrier and the contents carried are not lost.

The item carrier includes an item storage area that is capable of holding the item the user wants to store. The construction of the item storage area and the materials used will depend on the nature of the item to be stored. In many cases the item storage area may include one or more pockets into which the item(s) may be placed. In other cases, the item storage area may include one or more hooks for attaching items that can hook, one or more clips/clasps for attaching items that clip/clasp together, magnets that attach to metal or other magnets, and one or more touch fastener panels for attaching items with a mating touch fastener panel. It should be understood, therefore, that the item storage area can take on many different forms and is not limited to only the pocket-type examples discussed here.

The item carrier also includes a belt fastener member, which is a member attached to the item carrier that is capable of removably attaching the item carrier to a belt. The construction of the belt fastener member also can take on many different forms and is not limited to the loop forming strap examples discussed here.

A first example of the item carrier 200 is now discussed by referring generally to FIGS. 5-12. The item carrier 200 includes a body 202 defining a pocket 204, a lid strap 206, a locking strap 208, and a loop forming strap 210.

The body 202 includes an outer wall 212 and an inner wall 214 that together define the pocket 204 between them. The pocket may, if desired, further include a secondary pocket 216 therein. A plurality of holes 218 are formed through the body 202 to allow water to drain from the pocket 204.

In order to keep items stored within the pocket 204 from falling out, the item carrier 200 includes a closure designed to stay closed even during a violent fall or submersion in turbulent water. The lid strap 206 and locking strap 208 form for the closure.

The lid strap 206 is attached to the body 202 adjacent the pocket opening. A width W of the lid strap 206 approximates the width of the pocket opening.

Figure 8:
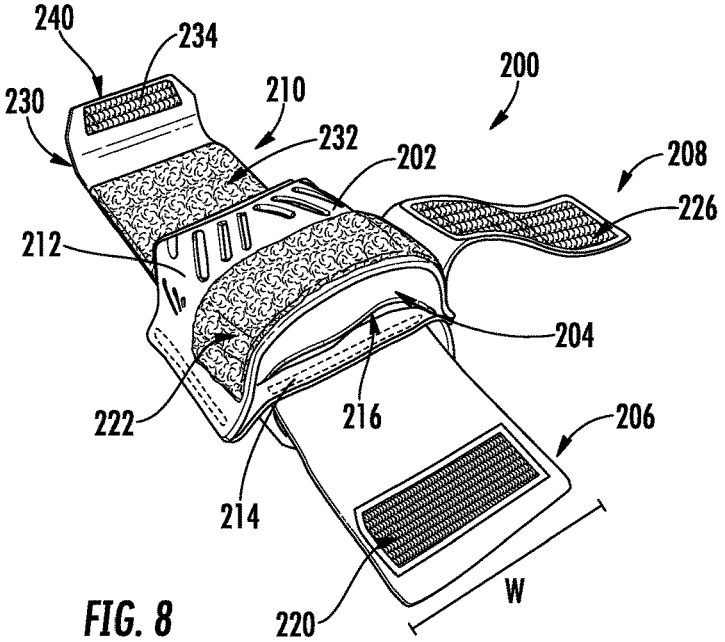
FIG. 8 is a top front perspective view thereof showing the lid strap, locking strap, and loop forming strap extended.
Figure 10:
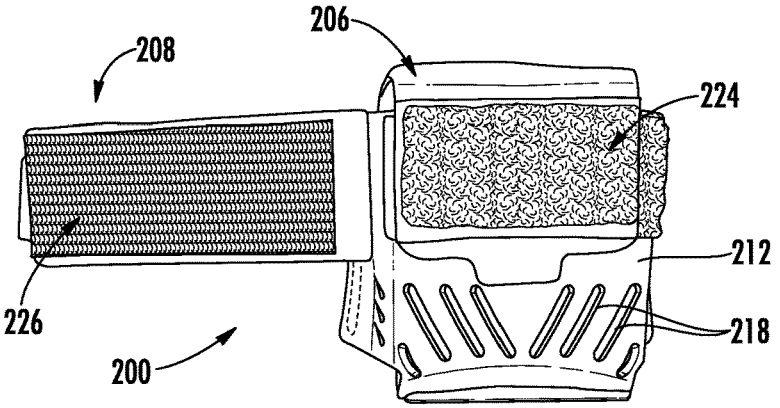
FIG. 10 is a front view thereof showing the locking strap extended and the lid strap closed over the pocket.

As depicted in FIG. 10, to close the pocket opening, a touch fastener panel 220 on the lid strap 206 may be adhered to a mating touch fastener panel 222 on the outer wall 212 of the body 202 (FIG. 8). The opposite side of the lid strap includes another touch fastener panel 224 that adheres to a touch fastener panel on the locking strap 208.

Figure 5:
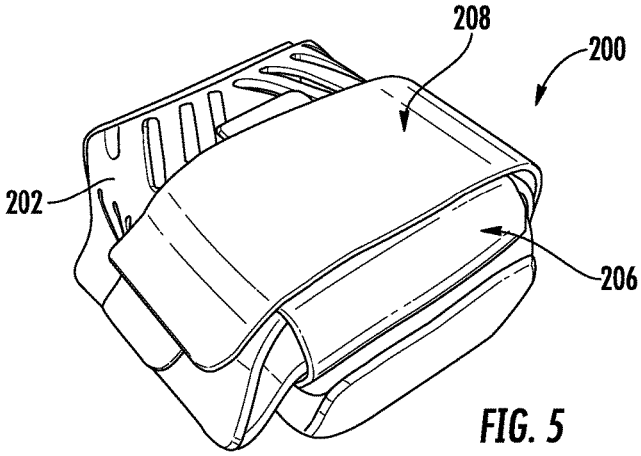
FIG. 5 is a top front perspective view of a first example of the item carrier.
Figure 7:
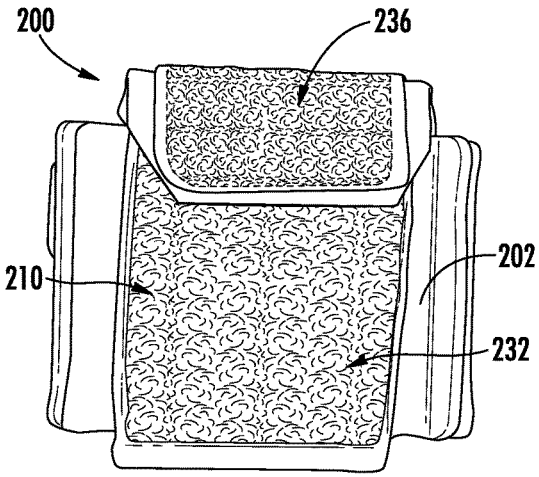
FIG. 7 is a back view thereof.
Figure 6:
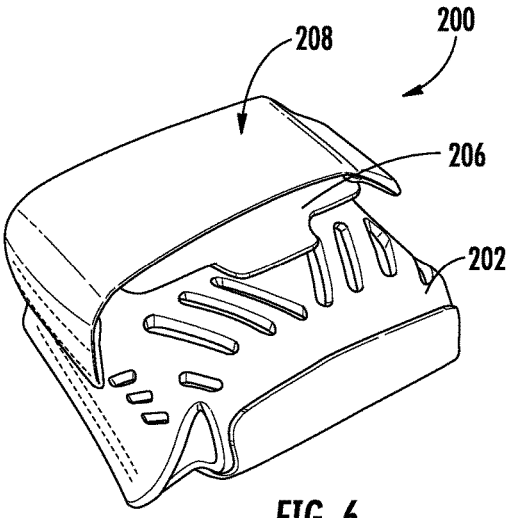
FIG. 6 is a bottom front perspective view thereof.

By folding the locking strap 208 onto the lid strap and adhering the touch fastener panels 224, 226 together, the locking strap 208 extends transversely across the lid strap 206, helping to keep the lid strap 206 in the closed position. This closed position is shown in FIGS. 5 and 6.

Figure 9:
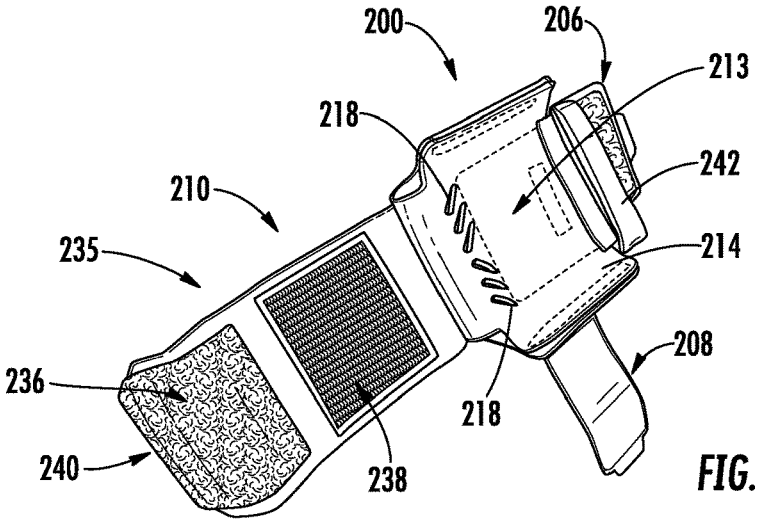
FIG. 9 is a bottom back perspective view thereof showing the lid strap, locking strap, and loop forming strap extended.

The loop-forming strap 210 is designed to form a loop that receives the belt. An outside surface 230 of the loop forming strap 210 includes a pair of touch fastener panels 232, 234 that can adhere to one another (FIG. 8). An inside surface 235 of the loop forming strap 210 includes a pair of touch fastener panels 236, 238 (FIG. 9).

On the back portion of the inside surface 235, the touch fastener panel 236 adjacent the free end 240 of the loop forming strap 210 is composed of the same touch fastener panel material as touch fastener panel 232 on the outside surface 230.

The second touch fastener panel 238 on the inside surface 235 is made of touch fastener material capable of adhering the touch fastener panel 118 on the inner surface 112 of the belt 100. This affixes the item carrier 200 to the belt 100 so that, when the item carrier is attached to the belt 100 as depicted in FIGS. 11 and 12, the item carrier 200 will not slide off of the belt 100.

In order to secure the loop-forming strap 210 in place, the free end 240 may be fed thru loop member 242 and folded back over onto itself so that touch fastener panel 234 overlaps touch fastener panel 232, allowing them to be adhered together, thereby securing the belt first end 106 between the loop forming strap 210 and the outer wall backside 213.

Figure 11:
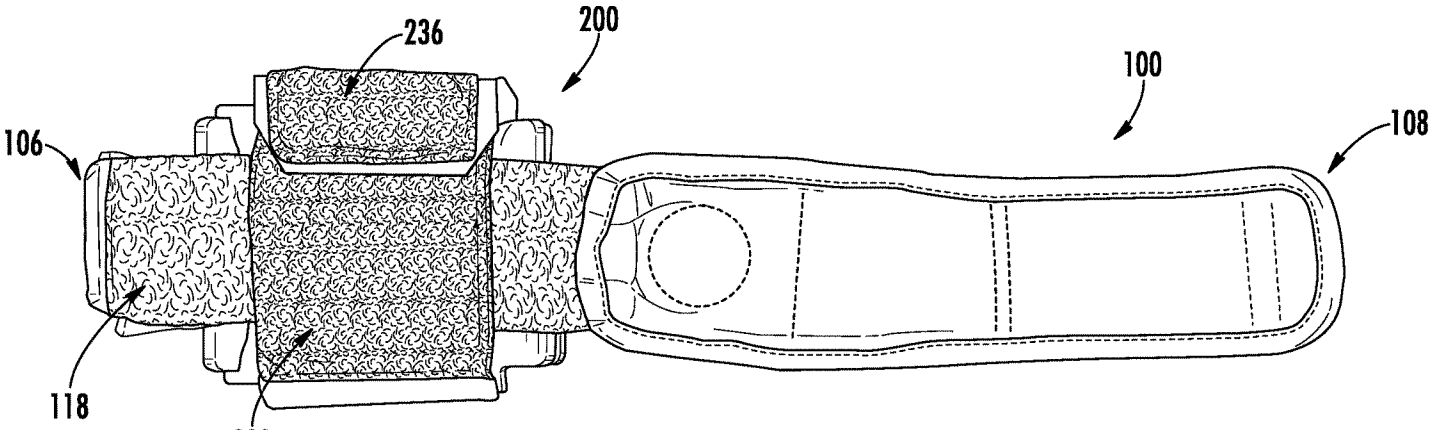
FIG. 11 is a is a plan view of the belt of FIG. 1 showing the inside surface of the belt with the item carrier of FIG. 5 thereon.
Figure 12:
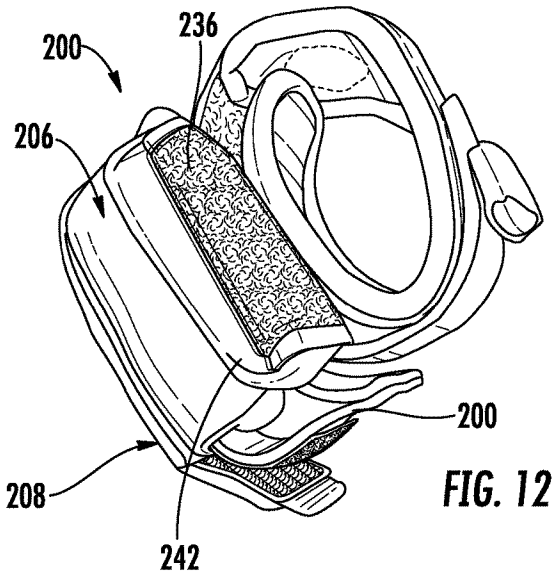
FIG. 12 is a top perspective view of the belt and item carrier of FIG. 11 with the belt closed as if being worn.
Figure 13:
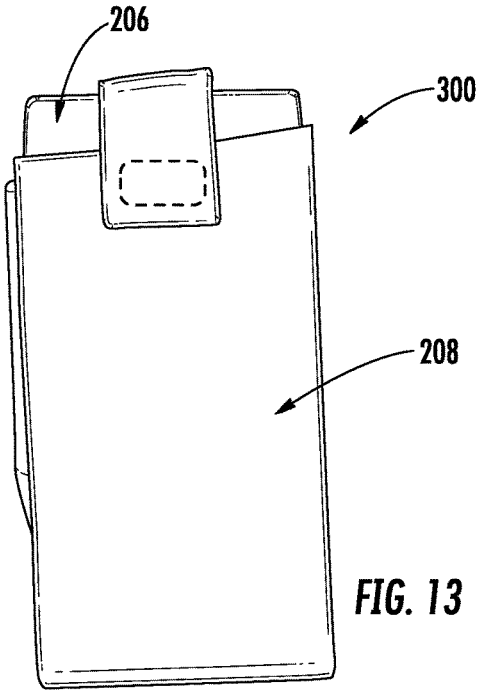
FIG. 13 is a front view of a second example of the item carrier.
Figure 14:
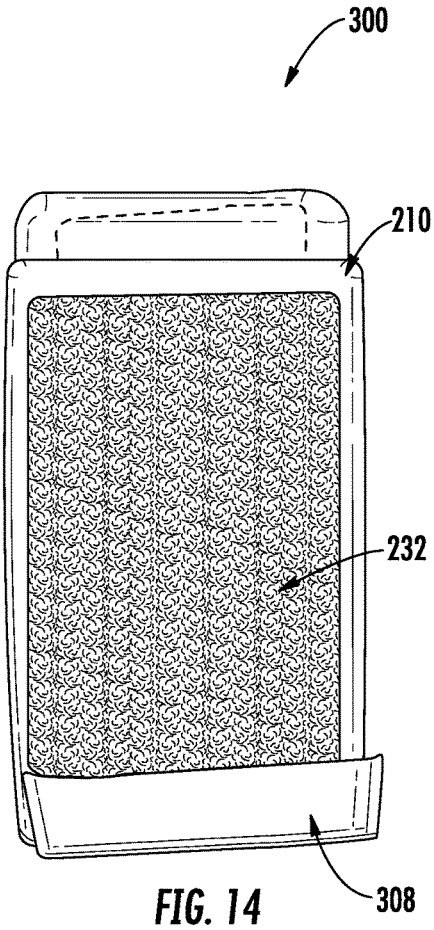
FIG. 14 is a back view thereof.

As shown in FIG. 11, touch fastener panels 232 and 236 form the backside of the item carrier 100 when attached to the belt and are made of the same touch fastener panel material. This touch fastener panel material, which may be the same material as touch fastener panel 118 of the belt 100, is selected to adhere to the touch fastener panel 116 on the outside surface of the belt 100. This arrangement prevents the item carrier 200 from weakening the locking integrity of the belt when worn because touch fastener panels 232, 236 essentially continue touch fastener panel 118 (see FIGS. 11 & 12), thereby allowing substantially full locking between touch fastener panels.

A second example of the item carrier 300 is now discussed by referring generally to FIGS. 13-20. Where appropriate, the same reference numerals are used to refer to like features from the first example discussed above.

Figure 16:
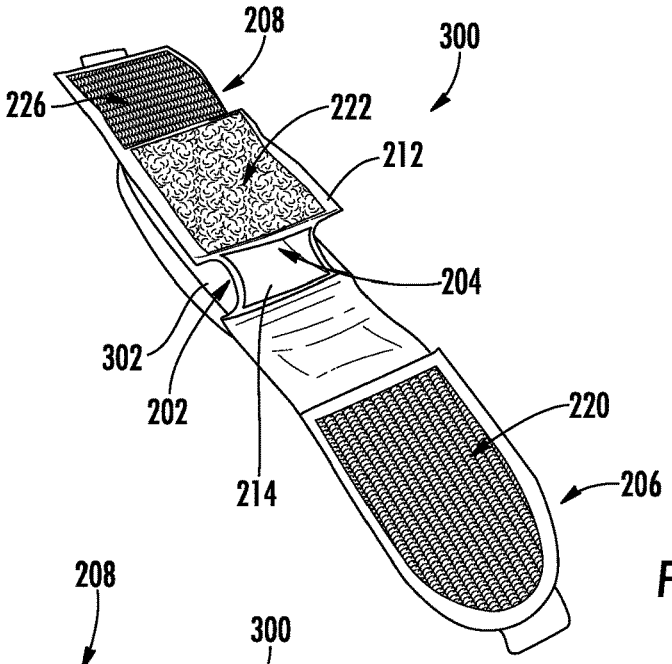
FIG. 16 is a top front perspective view thereof showing the lid strap and locking strap extended.
Figure 17:
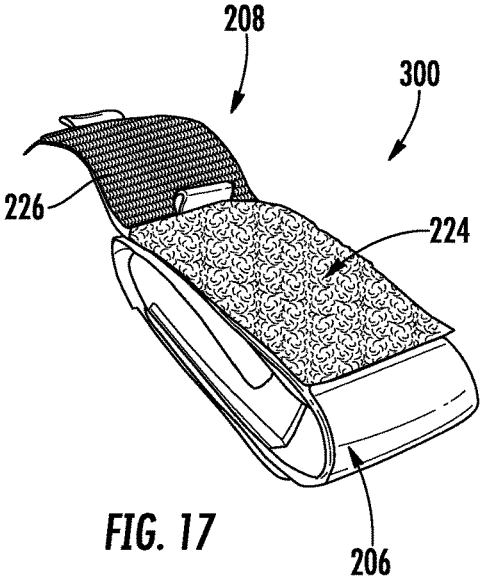
FIG. 17 is a top front perspective view thereof showing the locking strap extended and the lid strap closing the pocket.
Figure 18:
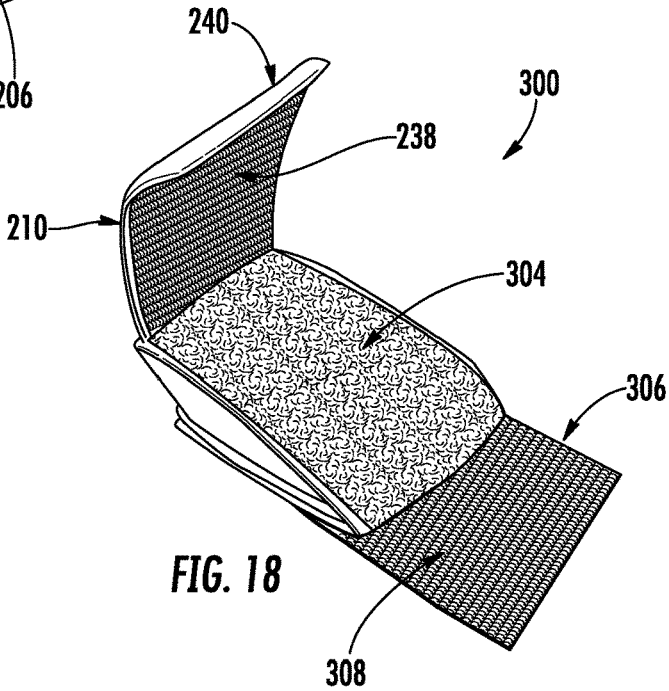
FIG. 18 is a back bottom perspective view thereof showing the loop forming strap and locking tab extended.

The second example of the item carrier 300 includes a body 202 with different construction. The body 202 includes opposed sidewalls 302 that are flexible/collapsible such that they may flex outward to allow bigger items to be carried, and the opposed sidewalls 302 may also fold inwardly into the pocket 204 as shown in FIG. 16, giving the item carrier 300 of the second example a thinner profile than that of the first example when the pocket 204 is transporting smaller items or is empty.

The closure mechanism on the second example of the item carrier 300 is also different. In this case, the locking strap 208 does not extend transversely across the lid strap 206. The locking strap 208 instead extends over the lid strap 206 from the bottom of the body 202 in parallel with the lid strap 206. The touch fastener panel 226 on the locking strap 208 can be adhered to the touch fastener panel 224 on the outside of the lid strap 206 to better ensure that the lid strap 206 remains secured to the mating touch fastener panel 222 on the outer wall 212 of the body 202, which further ensures that the pocket 214 is closed so items stored therein cannot fall out in use.

In other examples depending on the item to be transported, the locking strap 208 may not be necessary such that the pocket 214 is closed by affixing the touch fastener panel 220 on the inside of the lid strap 206 to the mating touch fastener panel 222 on the outer wall 212 of the body 202.

The second example of the item carrier 300 also includes a modified mechanism for attaching the item carrier to a belt 100. In this case, a touch fastener panel 304 is located on the body 202 on the backside of the item carrier 300 opposite the pocket 214.

The touch fastener panel 238 of the loop-forming strap 210 can be adhered to the touch fastener panel 118 on the inner surface 112 of the belt. The first end 106 of the outer surface 110 of the belt 100 may then be pressed against the touch fastener panel 304 on the backside of the body 202. The touch fastener panel 304 on the backside of the body 202 mates with the touch fastener panel 238 on the inside of the loop forming strap 210 above and below the width of the belt 100, because the height of the item carrier 300 is generally greater than the width of the belt 100 (see FIG. 19 for item carrier 300 height versus belt 100 width disparity for this example). Mating touch fastener panel 238 with touch fastener panel 304 secures the first end 106 of the belt 100 between the backside of the body 202 and the loop forming strap 210.

Touch fastener panels 238 and 304 may be made of different touch fastener material to adhere to each other, as explained above. This feature advantageously allows the user to attach the item carrier 300 to various portions of the belt 100. Such ability can be important, as it allows the item carrier 300 to be secured to different locations on the first end 106 of the belt 100 depending on the circumference of the wearer's appendage and preference of leash 102 location, to the extent the belt 100 contains a leash 102. This flexibility is accomplished in a manner that still allows the wearer immediate access to the leash 100 pull tab 107 for the reasons previously discussed.

The above configuration further allows the wearer to affix the item carrier 300 to any belt 100 worn on either side of the wearer's body, as is the case with all of the item carrier examples described herein. For example, surfers wear surfboard leashes on the ankle closest to the back of the board. Because different surfers have different preferences for which leg is positioned forward, known as a regular or goofy foot stance, and for the direction from which the leash 102 extends from the ankle (back or outside of the ankle), and as further complicated by different surfer ankle circumferences, the item carrier 300 is, therefore, adapted to be attached to the belt 100 at different positions to account for the preferences and ankle circumference of the user, while still providing immediate access to the pull tab 107, all in a manner that allows the item carrier 300 to remain connected to the leash 100 when the leash is removed from the surfer's ankle.

Figure 19:
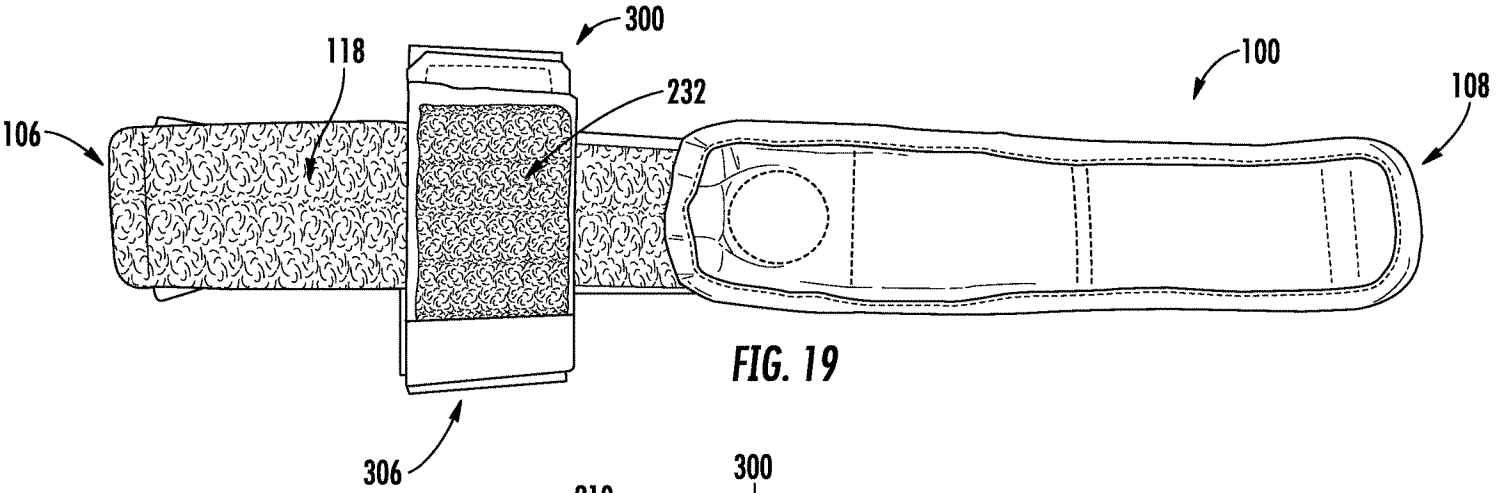
FIG. 19 is a plan view of the belt of FIG. 1 showing the inside surface of the belt with the item carrier of FIG. 13 thereon.

The second example of the item carrier 300 also includes locking tab 306 having a touch fastener panel 308 on its inside surface. The locking tab extends over the loop-forming strap 210, and the touch fastener panel 308 can be adhered to the bottom end of the touch fastener panel 232 on the backside of the loop-forming strap 210. This locks the loop-forming strap 210 around the first end 106 of the belt 100 as illustrated in FIG. 19.

Figure 20:
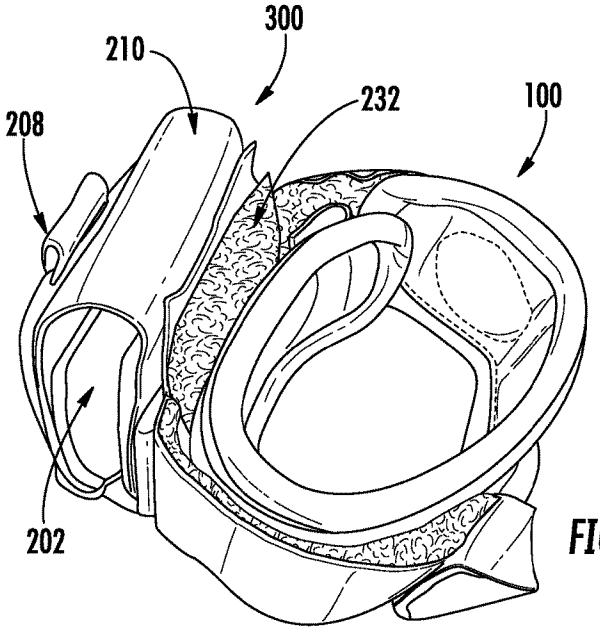
FIG. 20 is a top perspective view of the belt and item carrier of FIG. 19 with the belt closed as if being worn.
Figure 21:
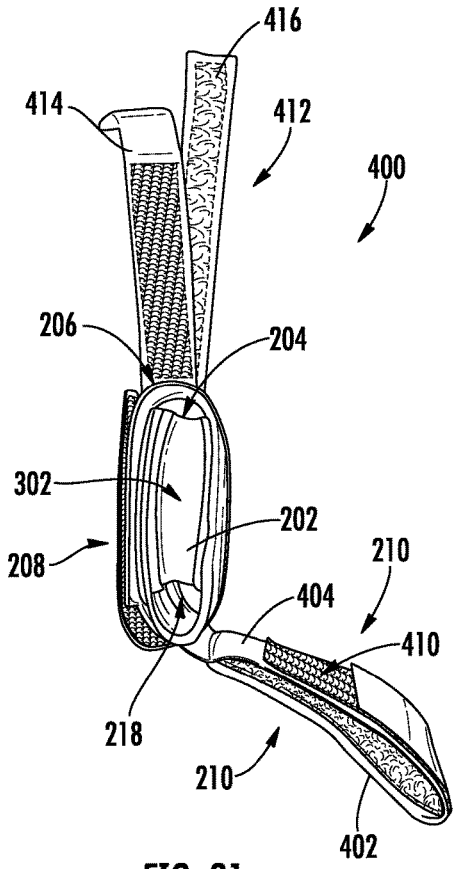
FIG. 21 is a side view of a third example of the item carrier.
Figure 22:
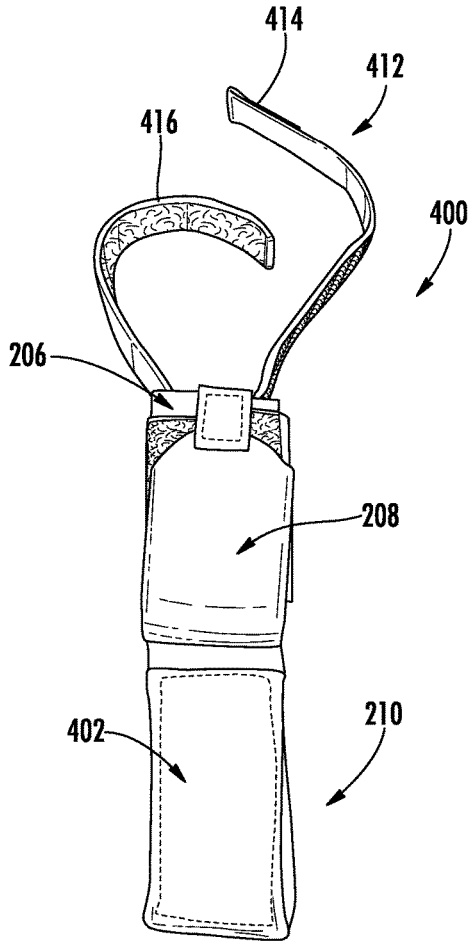
FIG. 22 is front view thereof with the loop forming strap extended.
Figure 23:
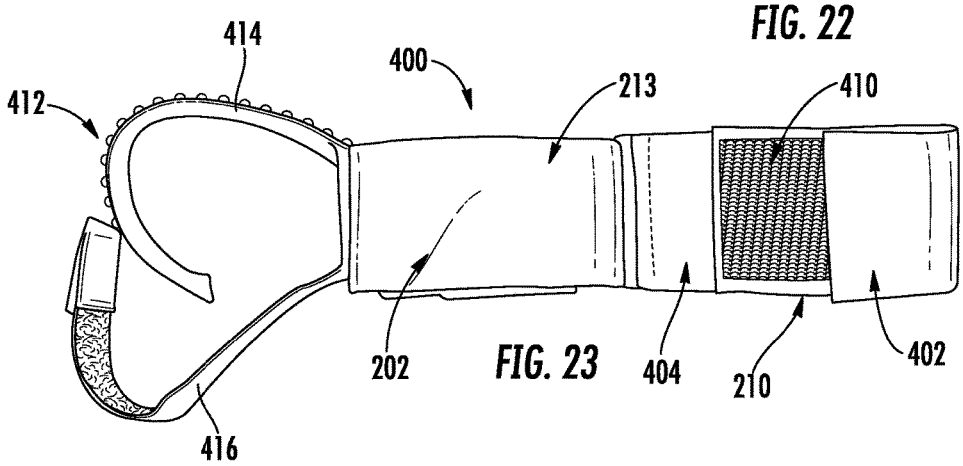
FIG. 23 is a back view thereof with the loop forming strap extended.
Figure 24:
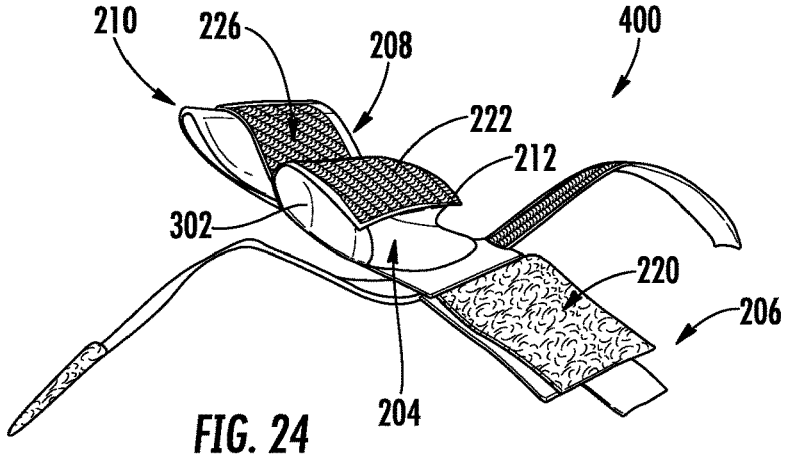
FIG. 24 is a top front perspective view thereof showing the lid strap, locking strap, and loop forming strap extended.
Figure 25:
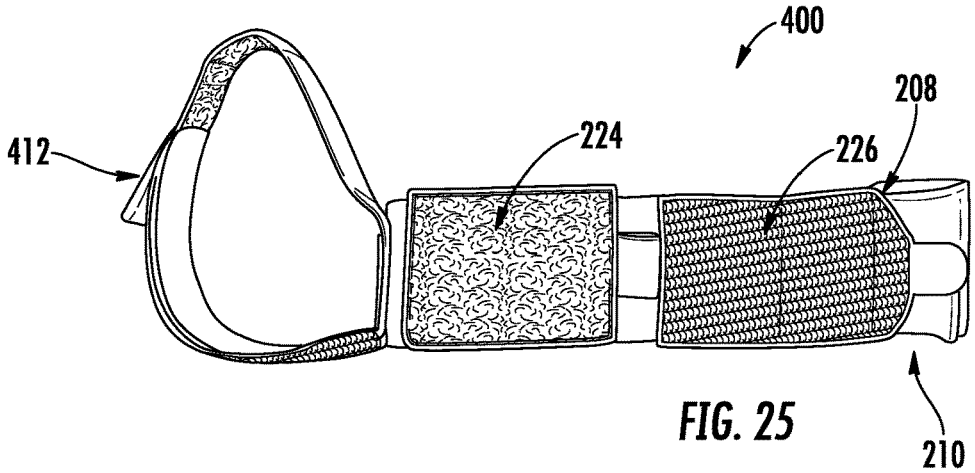
FIG. 25 is a top view thereof showing the locking strap extended and the lid strap closing the pocket.

The touch fastener panel 232 on the backside of the loop forming strap 210 can be adhered to the touch fastener panel 116 on the outer surface 110 of the belt 100 to ensure substantially full touch fastener panel locking, as previously explained, when the belt 100 is secured around the wearer's appendage (see FIG. 20).

Figure 15:
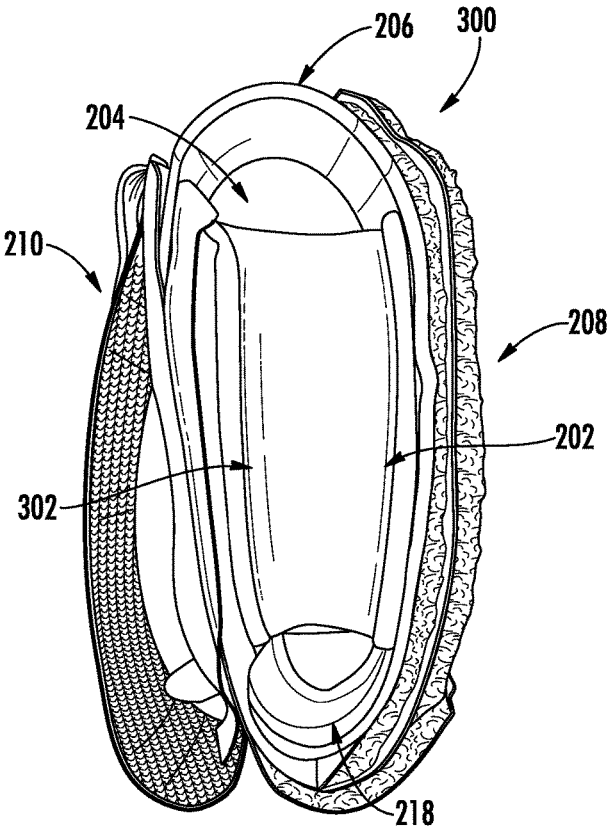
FIG. 15 is a side view thereof. The opposite side view is a mirror image.

Drainage holes 218 in item carrier 300 example are created by the gap between the top and bottom edge of the opposed sidewalls 302 and top and bottom of the body 202 (see FIG. 15).

A third example of the item carrier 400 is now discussed by referring generally to FIGS. 21-29. Where appropriate, the same reference numerals are used to refer to like features from the first and second examples discussed above.

The third example item carrier 400 has a body 202 and pocket 204 closure system similar to that embodied in item carrier 300 discussed previously. Drainage holes 218 for item carrier 400 are also similar to with item carrier 300's configuration. The difference between item carrier 400 and item carrier 300 is created by (i) the difference in how the loop forming strap 210 is configured, (ii) the end of the belt 100 to which the loop forming strap 210 attaches, (iii) a separate appendage band 412 that wraps around the wearer's appendage above (or below) where the item carrier 400 may reside on the wearer's appendage, and (iv) the manner in which the wearer may need to access the leash 100 pull tab 107 in order to remove the leash 100 from the wearer's appendage. All of these design differences are discussed below.

The above design differences exist because item carrier 400 is generally created to either carry heavier objects or to be used in extreme watersports (e.g. big wave surfing), or both. Item carrier 400 is generally intended to be worn on the back of the ankle such that the leash 102 is worn on the outside of the ankle, to the extent that a leash 102 is used, though item carrier 400 may be worn in any location on any appendage.

Continuing with big wave surfing as the example, item carrier 400 is designed to attach to a belt 100 such as a surfboard leash cuff that is worn around the surfer's ankle, whereby the item carrier 400 is worn on the back of the ankle and the leash 102 is positioned to reside on the outside of the surfer's ankle.

In this example substantially complete touch fastener panel locking is accomplished in item carrier 400 configuration via a manner different than the other example. Specifically, the manner in which substantially complete touch fastener panel locking is accomplished in item carrier 400 configuration may cause the belt 100 pull tab 107, or end of the belt 100 that the wearer first removes if the belt 100 does not have a pull tab 107, to become trapped between the loop forming strap 210 and the outer wall backside 213.

This presents a potential safety issue, as the wearer should be able to quickly access the pull tab 107 to remove the belt 100. This issue is overcome by the manner in which the item carrier 400 body 202 hinges open and away from the wearer's appendage and the loop forming strap 210 when the appendage band 412 is removed from the wearer's body, thereby providing access to the pull tab 107, all as further discussed below.

Figure 26:
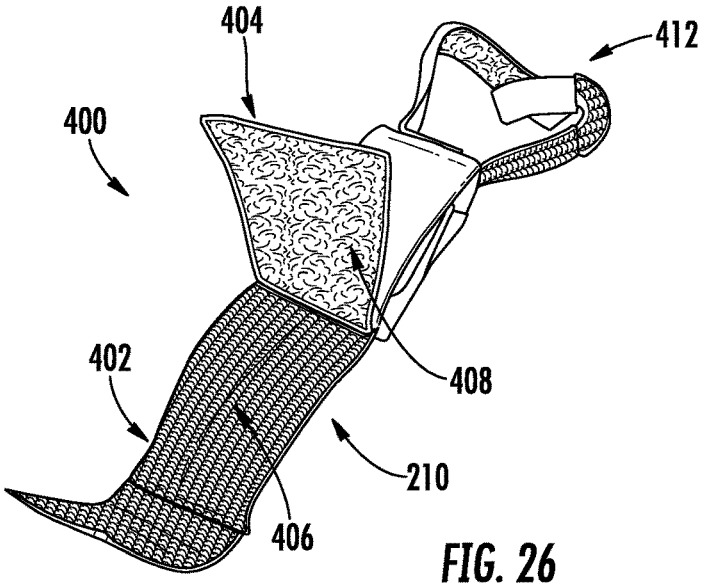
FIG. 26 is a back bottom view thereof, showing the first and second sections of the loop forming strap extended.
Figure 27:
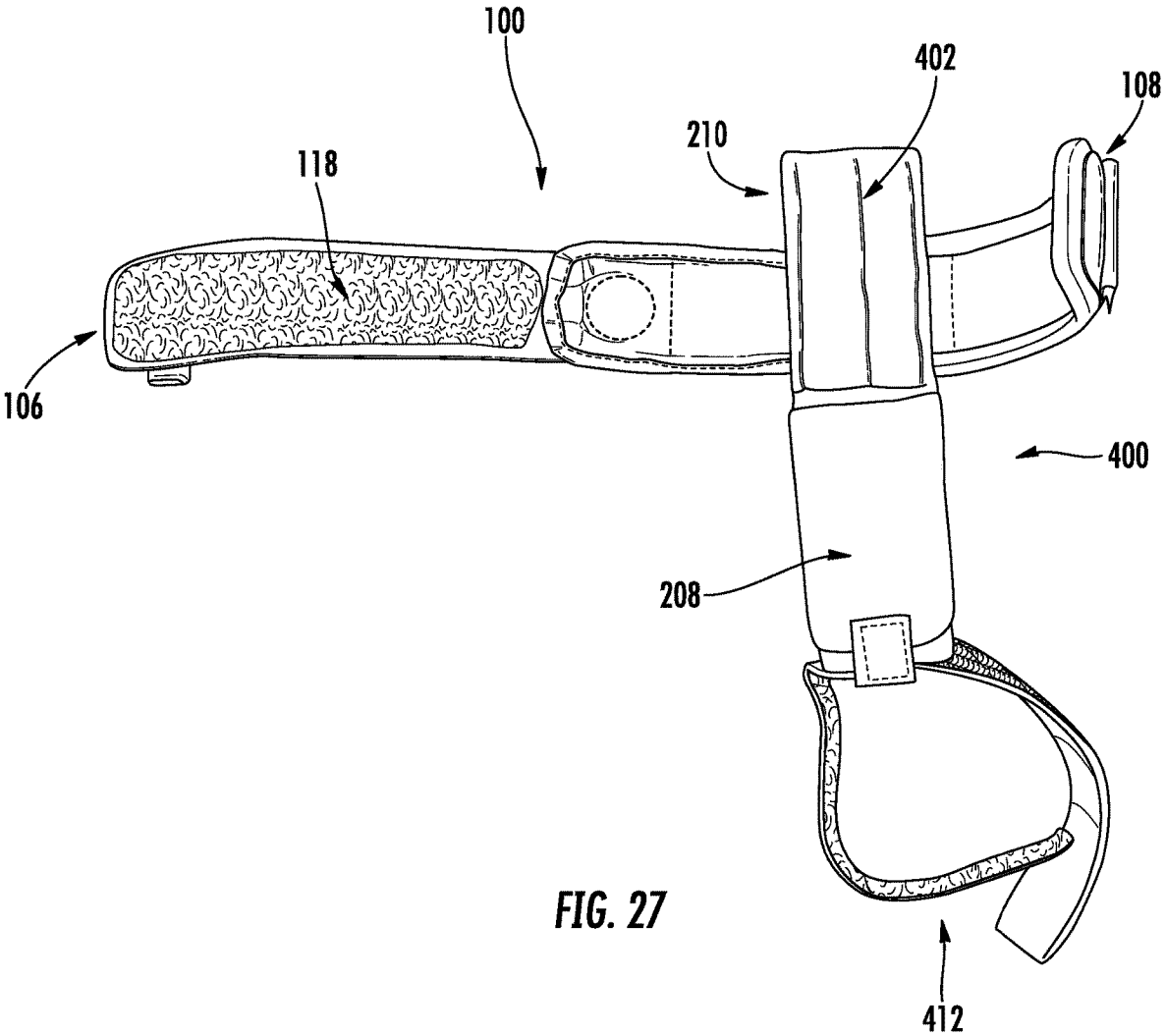
FIG. 27 is a plan view of the belt of FIG. 1 showing the inside surface of the belt with the item carrier of FIG. 20 thereon.

In the third example, the loop forming strap 210 includes a first section 402 and a second section 404 that are attached at one end and free at their respective opposite ends (FIG. 26). The first section 402 includes a touch fastener panel 406 located on its inside surface. The second section 404 is shorter than the first section 402 and includes a touch fastener panel 408 that may be adhered to touch fastener panel 406 and is made of different touch fastener panel material than touch fastener panel 406.

Located on an outside surface of the second section 404 is another touch fastener panel 410 made of touch fastener panel material that can adhere to touch fastener panel 406.

The loop forming strap 210 forms a loop for receiving the belt 100 by overlapping the free end of the first section 402 over touch fastener panel 410 (FIGS. 21, 23) and adhering the touch fastener panel 406 to touch fastener panel 410. Like the second example of the item carrier 300, the third example of the item carrier may be adhered to the belt 100 via either of touch fastener panel 118 or 116 because touch fastener panels 406 and 408 are made of different touch fastener panel material.

Generally, the touch fastener panel 116 on the outer surface 110 of the belt 100 is mated with the touch fastener panel 408 on the first section 402 of the loop forming strap 210. The free end of the first section 402 then overlays the free end of second section 404 and connects to touch fastener panel 410 on the outside surface of the second section 404 to lock the second end 108 of the belt 100 between the first section 402 and the second section 404 of the loop forming strap 210 (see FIG. 27).

Figure 29:
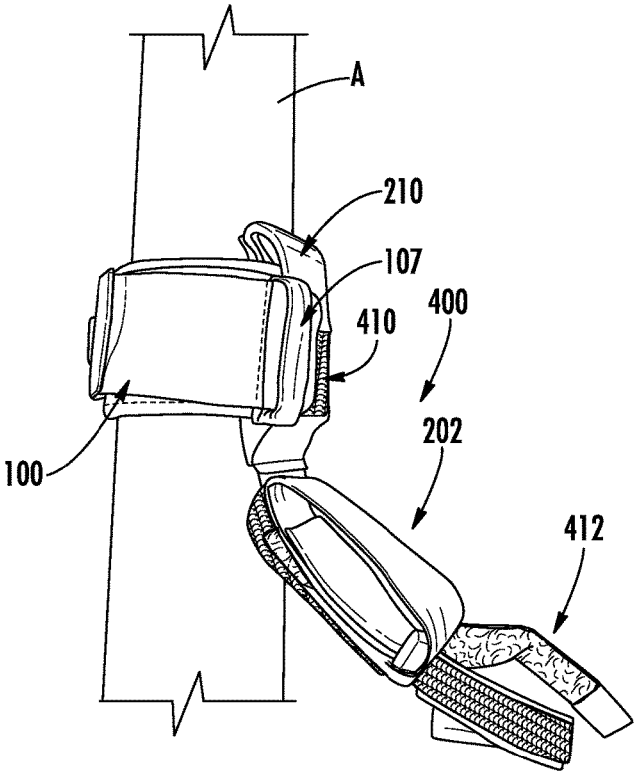
FIG. 29 depicts the belt and item carrier of FIG. 27 being worn on a person's appendage with the appendage band released.

Substantially complete touch fastener panel locking is then achieved by mating the touch fastener panel 118 located on the inner surface 112 of the first end 106 of the belt 100 with touch fastener panel 410 (see FIG. 29). However, the item carrier 400 body 202 is not yet secured to the wearer's appendage because the appendage band 412 discussed below is not yet connected to the wearer's appendage.

Figure 28:
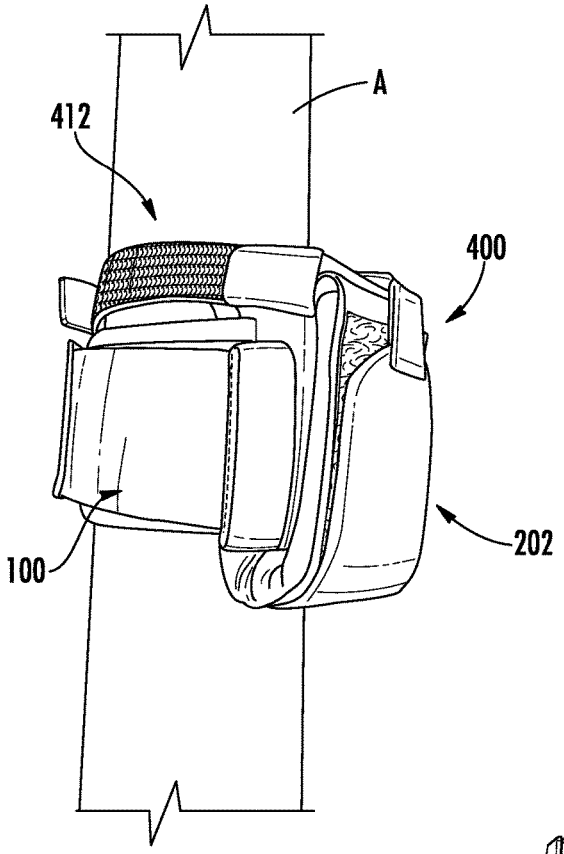
FIG. 28 depicts the belt and item carrier of FIG. 27 being worn on a person's appendage.

The item carrier 400 also includes an appendage band 412 that can be attached around the appendage on which the item carrier 400 is being worn. The appendage band 412 includes a pair of appendage band straps 414, 416 that are mateable by including touch fastener panels that adhere to each other (see FIGS. 22 & 23). As depicted in FIG. 28, when the item carrier 400 is being worn on an appendage A, the appendage band 412 is attached around the appendage A.

As illustrated in FIG. 29, when the appendage strap 412 is loosened, the body 202 of the item carrier 400 is able to hang from the belt 100, thereby providing quick access to the pull tab 107 to remove the belt 100 from the wearer's appendage, while still ensuring that the item carrier 400 remains secured to the second end 108 of the belt 100.

Although the item carrier is particularly useful for water sports, the scope of possible uses of the item carrier is not limited to this. The item carrier may be used for any activity where it is desirable to carry items using a wearable apparatus.

There are many items that the item carrier can be used to carry. A few of those items are now discussed.

The item carrier may be used to carry surf wax. Surfers often apply surf wax to their surfboards and often find it desirable to apply the wax while on the water, but many times do not have a secure way to carry the wax when wearing a wetsuit or bikini. The surfer can use the item carrier to carry surf wax out onto the water by placing the surf wax into the item carrier's pocket.

The item carrier may be used to carry keys. Watersports enthusiasts often hide their keys on the beach or around their car. The item carrier provides a secure way to store those keys so the enthusiast can carry them on his or her body.

Figure 30:
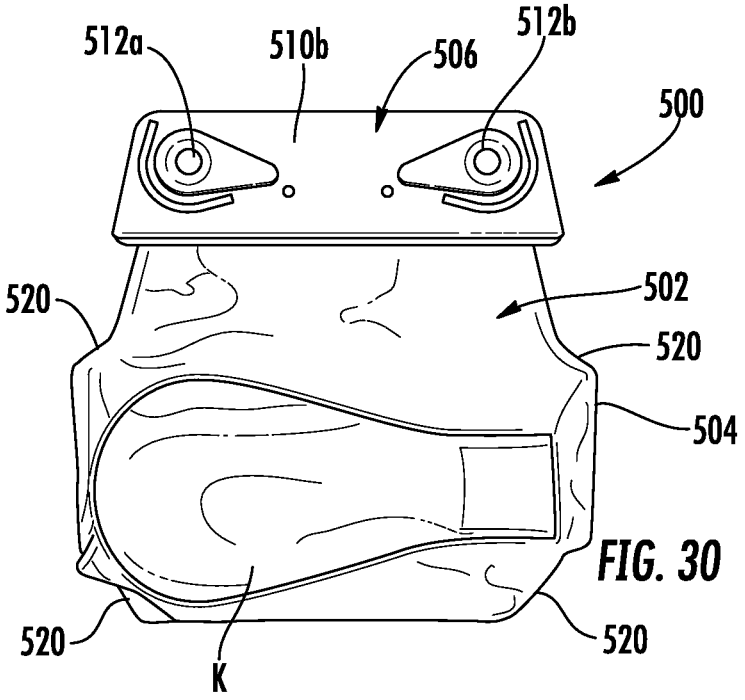
FIG. 30 is a side view of an example of a waterproof container that may be used in combination with the item carrier.
Figure 31:
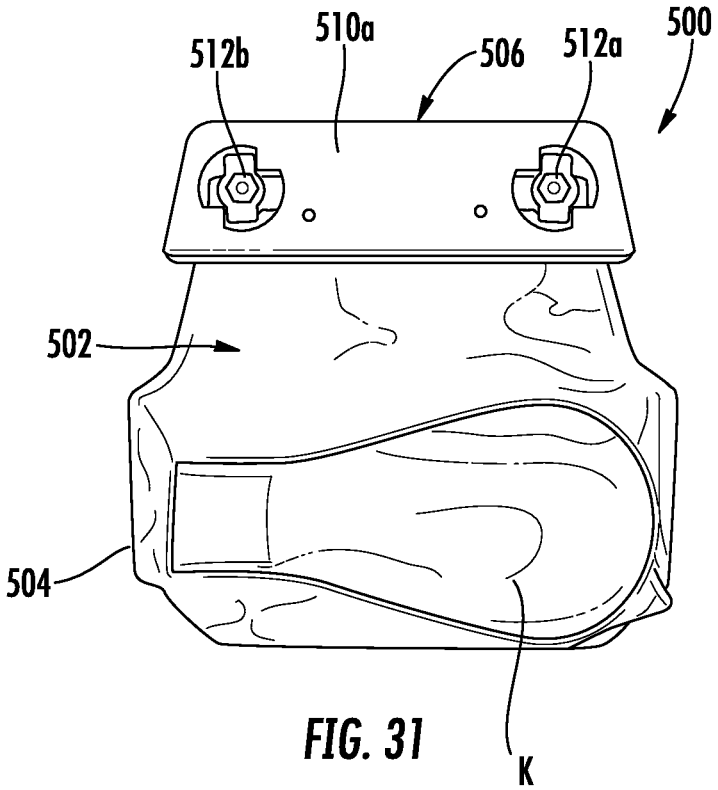
FIG. 31 is the opposite side view thereof.
Figure 32:
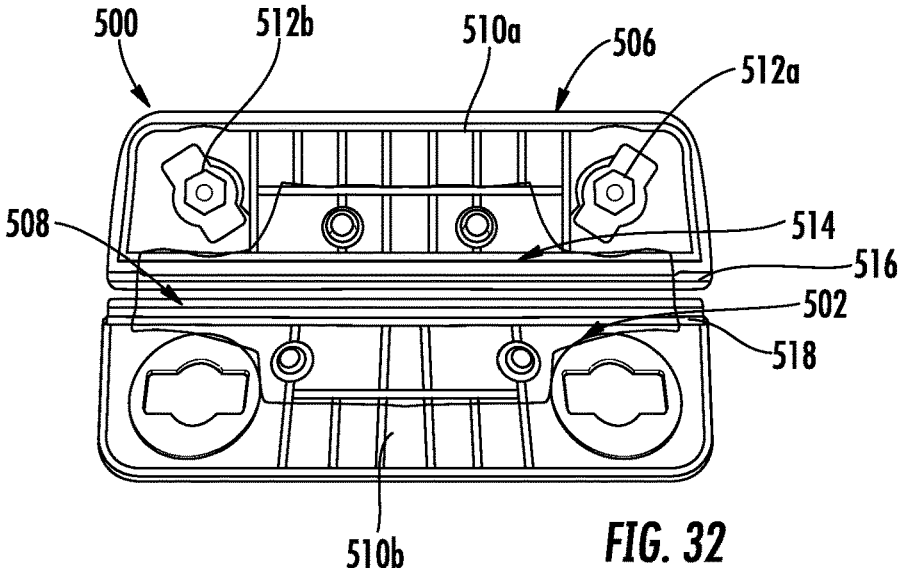
FIG. 32 is a top view thereof.

In this regard, it may be desirable to place electronic keys into a waterproof container that can be stored in the pocket of the item carrier. Referring to FIGS. 30-32, an example of a waterproof container including a key K stored within it is shown. The container 500 includes a bag 502 made of waterproof material. The outer periphery 504 of the bag 502 is sealed to prevent leaks.

A bag closure 506 seals the bag's opening 508. The bag closure includes a pair of rigid closure members 510*a,b* that can be locked together via a pair of locks 512*a,b*. The combination of rigid closure members 510*a,b* and locks 512*a,b* may be formed by clasps, clips or magnets in other examples. The bag opening 508 is sealed when an upper section 514 of the bag 502 is pressed within a tongue 516 and a groove 518 joint formed when the closure members 506 are locked together.

The bag 502 includes tapered edges 520 so as to allow for a smaller closure 506 than the length of the bag, which minimizes surface area of the container 500 when inserted into an item carrier, while still allowing the key K to be inserted into the bag 502 at a diagonal angle. Tapered edges 520 also ensure that the bag 502 and closure 506 do not extend out of the holes 218, which ensures substantially no drag is created by the container 500 when inserted into an item carrier used in the water.

The item carrier may be used to carry a camera. In one example, surfers will film themselves surfing by attaching a waterproof camera to a mouthpiece and holding the mouthpiece in their mouths during filming. The item carrier may be adapted to carry such a device by including a slot through the lid strap.

Figure 33:
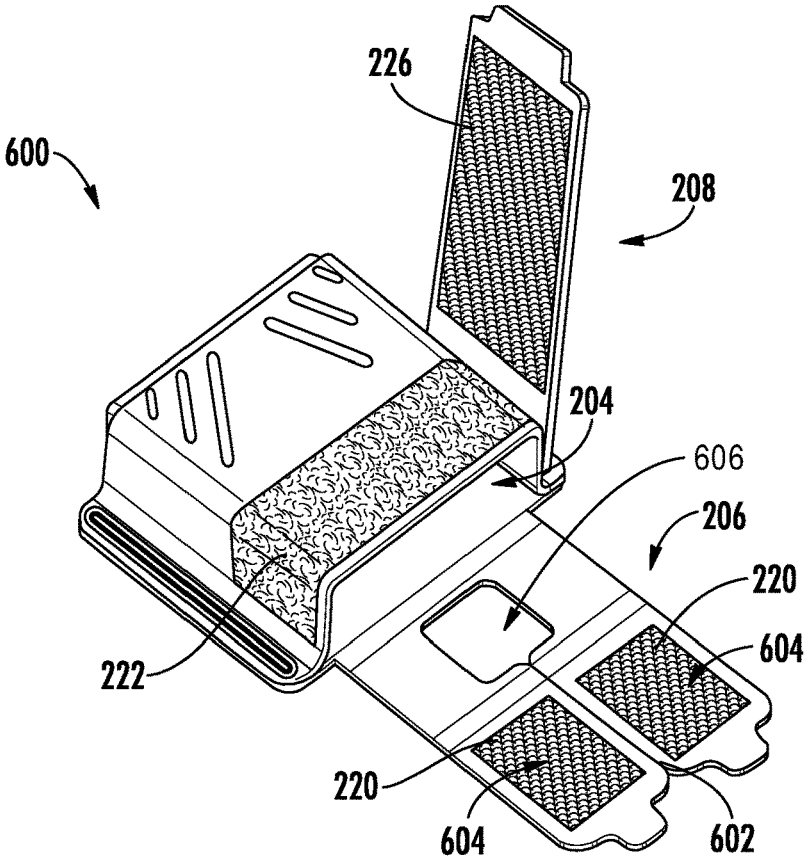
FIG. 33 is a variation of the first example of the item carrier shown with a different lid strap.

Referring to FIG. 33, a variation of the first example of the item carrier 600 is shown with a different lid strap 206. This lid strap 206 includes a slit 602 dividing the lid strap into two separable flaps 604. The slit 602 extends to an opening 606 through which a long item, such as a water camera mount, stored in the pocket 204 may extend.

The item carrier may be constructed from any number of materials that are durable and flexible, including, but not limited to, fabrics such as polyester, cotton, polyurethane, LYCRA, SPANDEX and NYLON, polypropylene, neoprene, santoprene, plastic, rubber, or the like. Various components of the item carrier may be attached together via any conventional method such as, for example, stitching, using adhesive, welding, or the like.

In some examples components of the item carrier may be permanently attached to the belt.

It should be understood that the individual features the examples of the item carrier described above may be interchanged between different examples.

Some possible examples and features of the item carrier have been described above, but the scope of possible features and details is not limited only to those described. There are many possible changes that may be made to the item carrier described above without departing from the scope of what is claimed.

That which is claimed is:

1. An item carrier comprising:

a body having a front side defining an item storage area capable of removably holding an item to be stored; and a belt fastener member attached to the body and including a first touch fastener panel, the belt fastener member being configured to fasten to a belt in such a way that the belt fastener member forms a loop around the belt and the first touch fastener panel adheres to the belt;

wherein the item storage area is on a front side of the body and a second touch fastener panel is on a back side of the body, the second touch fastener panel substantially covering the back side;

wherein the belt fastener member includes a loop forming strap attached to the body, the first touch fastener panel is positioned on the loop forming strap, and a third touch fastener panel is positioned on the loop forming strap on an opposite side of the loop forming strap from the first touch fastener panel.

2. The item carrier of claim 1, wherein the first touch fastener panel is positioned on a surface of the loop forming strap that faces the body.

3. The item carrier of claim 1, wherein:

the first touch fastener panel is positioned on a surface of the loop forming strap that faces the back side of the body; and the first and second touch fastener panels are made of different touch fastener material.

4. The item carrier of claim 1, wherein the item storage area includes a pocket having a lid strap that closes the pocket and a locking strap that overlaps the lid strap and adheres to the lid strap with a touch fastener.

5. The item carrier of claim 1, wherein the item storage area includes a pocket having a lid strap that closes the pocket and a locking strap that transversely overlaps the lid strap and adheres to the lid strap with a touch fastener.

6. The item carrier of claim 1, wherein when the belt fastener member forms a loop around the belt and the belt is positioned between and in direct contact with the first touch fastener panel and the second touch fastener panel.

7. The item carrier of claim 1, wherein the first touch fastener panel is either a hook or a pile of a hook and pile fastener.

8. An item carrier comprising:

a body having a front side defining an item storage area capable of removably holding an item to be stored; and a belt fastener member attached to the body for fastening to a belt, the belt fastener member having a first section with a first touch fastener panel thereon and a second section with a second touch fastener panel thereon, the first section and second section together being formable into a loop in such a way that that the first and second touch fastener panels are inside the loop, the first and second touch fastener panels being made of different touch fastener material;

wherein the item storage area is on a front side of the body and the second touch fastener panel is on a back side of the body, the second touch fastener panel substantially covering the back side;

wherein the belt fastener member includes a loop forming strap attached to the body, the first touch fastener panel is positioned on the loop forming strap, and a third touch fastener panel is positioned on the loop forming strap on an opposite side of the loop forming strap from the first touch fastener panel.

9. The item carrier of claim 8, wherein the item storage area includes a pocket having a lid strap that closes the pocket and a locking strap that overlaps the lid strap and adheres to the lid strap with a touch fastener.

10. The item carrier of claim 8, wherein the item storage area includes a pocket having a lid strap that closes the pocket and a locking strap that transversely overlaps the lid strap and adheres to the lid strap with a touch fastener.

11. The item carrier of claim 8, wherein the first touch fastener panel is either a hook or a pile of a hook and pile fastener and the second touch fastener panel is the other of a hook or a pile of a hook and pile fastener.

12. An item carrier comprising:

a body having a front side defining an item storage area capable of removably holding an item to be stored and a back side having a first touch fastener panel thereon substantially covering the back side; and a loop forming strap extending from the body over the back side, the loop forming strap having an inside surface facing the back side and an outside surface opposite the inside surface, the inside surface including a second touch fastener panel made of different touch fastener material than the first touch fastener panel, the outside surface including a third touch fastener panel.

13. The item carrier of claim 12, wherein the item storage area includes a pocket having a lid strap that closes the pocket and a locking strap that overlaps the lid strap and adheres to the lid strap with a touch fastener.

14. The item carrier of claim 12, wherein the item storage area includes a pocket having a lid strap that closes the pocket and a locking strap that transversely overlaps the lid strap and adheres to the lid strap with a touch fastener.

15. The item carrier of claim 12, wherein the loop forming strap is configured to fasten to a belt in such a way that the loop forming strap forms a loop around the belt and the second touch fastener panel adheres to the belt.

* * * * *